United States Patent [19]

Troup

[11] Patent Number: 4,960,493

[45] Date of Patent: Oct. 2, 1990

[54] PLATING ON METALLIC SUBSTRATES

[75] Inventor: Sue Troup, Calabasas, Calif.

[73] Assignee: Hughes Aircraft Company, Los Angeles, Calif.

[21] Appl. No.: 332,926

[22] Filed: Apr. 3, 1989

Related U.S. Application Data

[63] Continuation-in-part of Ser. No. 223,205, Jul. 22, 1988, abandoned.

[51] Int. Cl.[5] ..... C25D 5/38; C25D 5/10

[52] U.S. Cl. ..... 204/32.1; 204/29; 204/40

[58] Field of Search ..... 204/29, 32.1, 40

[56] References Cited

U.S. PATENT DOCUMENTS 4,137,131 1/1979 Donaghy ..... 204/32.1
4,212,907 7/1980 Wright ..... 427/309

OTHER PUBLICATIONS

F. A. Lowenheim, Electroplating, McGraw-Hill Book Co., NY, 1978, pp. 80–83, 224.
H. Silman et al., Protective and Decorative Coatings for Metals, Finishing Publications, Ltd., Teddington, Middlesex, England, 1978, pp. 124–127.

*Primary Examiner*—John F. Niebling
*Assistant Examiner*—William T. Leader
*Attorney, Agent, or Firm*—V. D. Duraiswamy; W. K. Denson-Low

[57] ABSTRACT

A metal such as copper is deposited as a layer upon a substrate such as molybdenum by cleaning the substrate, etching the substrate to remove gross oxides thereupon, treating the substrate in a concentrated acid, such as hydrochloric acid, with the substrate made cathodic, depositing a metal strike layer, such as nickel or gold, on the substrate, and depositing the metallic layer overlying the strike layer. The cathodic treatment in the concentrated acid permits deposition of the strike layer before the oxide layer reforms.

16 Claims, 2 Drawing Sheets

PLATING ON METALLIC SUBSTRATES

This application is a continuation-in-part of Ser. No. 223,205, filed July 22, 1988, now abandoned.

BACKGROUND OF THE INVENTION

This invention relates to the deposition of metals on metallic substrates, and, more particularly, to the deposition on substrates that reform oxides rapidly.

Molybdenum is widely used in the microelectronics industry in holders for ceramic packages. The packages, in turn, receive and support microelectronic devices such as integrated circuits. Molybdenum is used in this application because its coefficient of thermal expansion closely approximates that of typical ceramics used as packages. When the holder, package, and integrated circuit are heated or cooled, there is little tendency for the molybdenum to debond from the ceramic.

The ceramic package is typically soldered or brazed to the molybdenum holder. The molybdenum is first coated with copper, prior to the joining operation, to facilitate joining. The deposition of a layer of copper on molybdenum is difficult, because molybdenum quickly forms a tenacious oxide after cleaning operations. If the molybdenum oxide on a molybdenum surface is removed, as by etching, the oxide layer reforms in a time on the order of milliseconds. The reformed layer is initially very thin. It is, however, sufficiently thick to prevent ready adherence of copper or a nickel strike layer to the molybdenum surface, even if the deposition is accomplished immediately after etching. The deposition of a copper layer on molybdenum is therefore not readily performed, and requires a special process.

Several techniques have been developed to permit deposition of a copper layer upon molybdenum. The chromium deplate/plate process first removes the oxide by making the molybdenum the anode of a cell. The molybdenum is then moved to the cathode, and chromium is deposited in an effort to prevent the oxide from reforming. A nickel strike layer is deposited over the chromium, and a copper layer is deposited over the nickel layer. The process is inefficient and largely ineffective, because the oxide can reform within milliseconds and because the eletrochemical plating efficiency of the chromium is only about 15%. Typically, only 60% of the plated parts produced by this method are acceptable. The time required to shift the molybdenum piece from the anode to the cathode permits the oxide to reform in an amount sufficient to interfere with the chromium plating. Even where the process is operable, the resulting layer of chromium and nickel is magnetic, and may adversely affect the operation of the microelectronic device mounted on the ceramic. Finally, but perhaps most significantly, the process requires the use of hexavalent chromium, which can be an environmental hazard when it is disposed of.

A second approach utilizes a hydrogen furnace treatment of the molybdenum piece. The molybdenum surface is etched to remove the oxide, and then cycled in a hydrogen furnace. Immediately after this step, a gold strike layer is deposited upon the surface. The molybdenum piece is returned to the hydrogen furnace, and the process of depositing gold and refiring in hydrogen is repeated three additional times. Finally, copper is deposited overlying the gold strike layers. This process is successful in providing a copper layer, but is expensive, as a hydrogen furnace costs several hundred thousand dollars, and gold plating is used. The process is also time consuming, since about 16–20 hours is required to complete the deposition cycle.

Other, more exotic, techniques have been used to deposit copper onto molybdenum. In magnetron sputtering, for example, a gold strike layer is deposited upon the molybdenum by sputtering in a vacuum, and then the copper layer is deposited overlying the gold layer. The principal difficulty with such approaches is that they are expensive and not adapted to mass production of irregularly shaped molybdenum parts on a routine basis.

At the present time, there is no mass production technique for depositing a copper layer on molybdenum, that is efficient in producing a high percentage of good pieces, and is also inexpensive. Such a process is needed, particularly in the electronics industry and in other areas where molybdenum is used in similar applications. There is also a need for a process for plating a copper layer onto molybdenum without introducing magnetic material which can be detrimental for certain applications. The present invention fulfills these needs, and further provides related advantages.

SUMMARY OF THE INVENTION

The present invention provides a process for plating a copper layer onto molybdenum that is efficient in that it produces a high fraction of acceptably plated pieces. It is also inexpensive, as it does not require equipment other than conventional electroplating apparatus and does not utilize multiple layers of expensive coating materials such as gold. The process is well suited for use in commercial mass production operations. Equally importantly, chromium, particularly in the form of hexavalent chromium, is not utilized in the process, avoiding this source of environmental damage.

In accordance with the invention, a process for depositing copper onto the surface of a molybdenum substrate comprises the steps of furnishing a piece of molybdenum to serve as a substrate; cleaning the surface of the substrate; etching the surface of the substrate to remove gross oxide from the surface; placing the surface of the substrate into concentrated hydrochloric acid with the substrate made cathodic; transferring the substrate from the hydrochloric acid into a stike solution containing a magnetic material such as nickel or a non-magnetic material such as gold, while maintaining the cathodic potential on the substrate; depositing a strike layer onto the substrate from the strike solution with the substrate cathodic; and depositing copper onto the substrate overlying the strike layer.

More specifically, and further in accordance with the invention, in one embodiment, a process for depositing copper onto the surface of a molybdenum substrate comprises the steps of furnishing a piece of molybdenum to serve as a substrate; cleaning the surface of the substrate; rinsing the surface of the substrate in cold water; etching the surface of the substrate in a mixture of nitric acid and a second component selected from the group consisting of sulfuric acid and ammonium bifluoride to remove gross oxide from the surface; rising the surface of the substrate in cold water; etching the surface of the substrate in aqueous potassium ferricyanide to remove gross oxide from the surface; rinsing the surface of the substrate in cold water; placing the surface of the substrate into aqueous hydrochloric acid solution having a concentration of at least about 25 percent acid, with the substrate made cathodic at about 6 volts; transferring the substrate from the hydrochloric acid into an acidic aqueous solution of nickel chloride, while maintaining the cathodic potential on the substrate; depositing a nickel strike layer onto the substrate from the strike solution at a cathodic voltage of about 3 volts; rinsing the surface of the substrate in cold water; and depositing copper onto the substrate overlying the nickel strike layer from a copper cyanide solution.

More specifically, in a second embodiment, a process for depositing copper onto the surface of the molybdenum substrate comprises the steps of furnishing a piece of molybdenum to serve as a substrate; cleaning the surface of the substrate; rinsing the surface of the substrate in cold water; etching the surface of the substrate in a mixture of nitric acid and a second component selected from the group consisting of sulfuric acid and ammonium bifluoride to remove gross oxide from the surface; rinsing the surface of the substrate in cold water; etching the surface of the substrate in aqueous potassium ferricyanide or aqueous potassium hydroxide to remove gross oxide from the surface; rinsing the surface of the substrate in cold water; placing the surface of the substrate in a cathodic-room-temperature solution of concentrated hydrochloric acid and applying a current of about 500–1000 amps-per-square foot; transferring the substrate from the hydrochloric acid immediately to a hydrochloric acid gold strike at an elevated temperature while applying a current; rinsing the surface of the substrate in cold water; and depositing copper onto the gold strike layer from a copper cyanide solution. Finally, a thin gold layer may optionally be deposited overlying the copper layer to protect it from oxidation.

The present invention thus provides an approach for removing the oxide and preventing its reformation to provide time to deposit the nickel strike or the gold strike layer. This approach is applicable to deposition of layers on other materials that reform oxides rapidly after etching. In accordance with this more general aspect of the invention, a process for depositing a metal onto the surface of a metallic substrate, comprises the steps of cleaning the surface of the substrate; removing the gross oxide from the surface of the substrate; treating the surface of the substrate in concentrated acid with the substrate cathodic; and depositing metal onto the surface of the substrate with the substrate cathodic.

The present approach has the advantages that it is readily accomplished with existing electrolytic deposition apparatus, is inexpensive compared with alternative approaches, and produces a high fraction of acceptable parts. Other features and advantages of the present invention will be apparent from the following more detailed description of the preferred embodiment, taken in conjuction with the accompanying drawings, which illustrate, by way of example, the principles of the invention.

DETAILED DESCRIPTION OF THE INVENTION

Figure 1A:
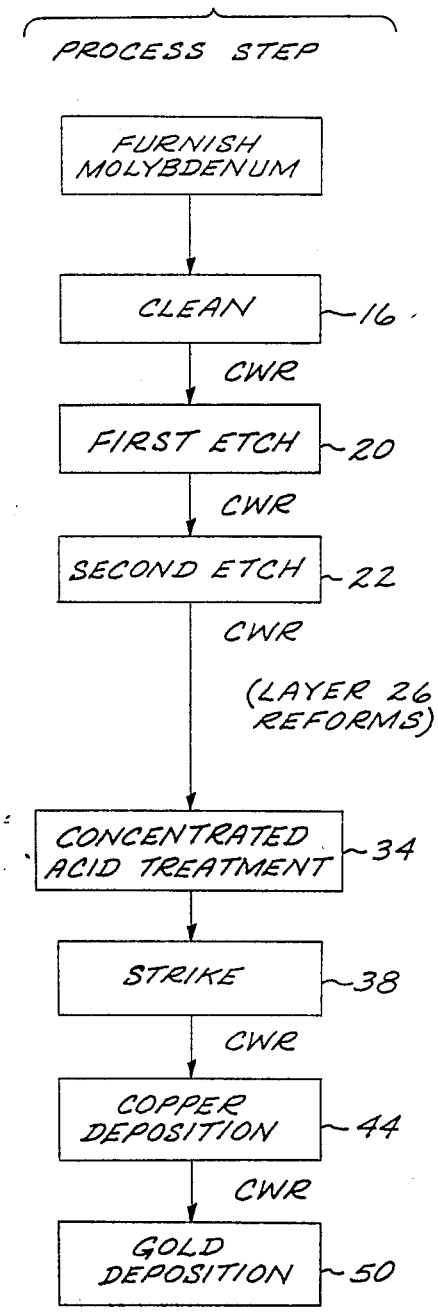
FIG. 1(*a*) is a pictorial flow chart of the preferred process of the invention, FIG. 1(*b*) shows the structure at the molybdenum surface at each step shown in FIG. 1(*a*)
Figure 1B:
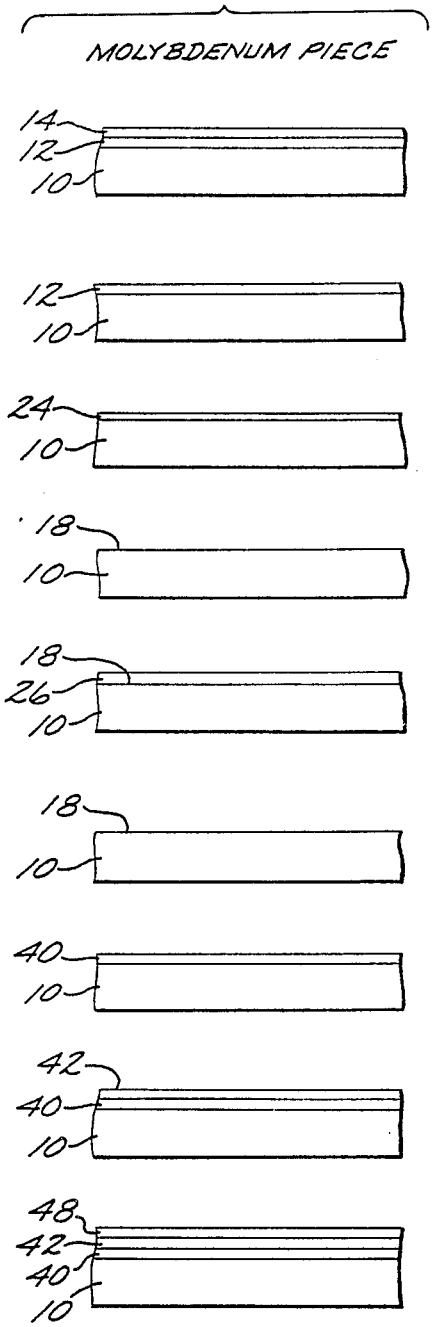

FIG. 1(*a*) is a flow chart of the preferred process steps, together with a depiction of the structure of a piece of molybdenum in elevation. (The thicknesses of layers are shown schematically and not to scale in FIG. 1(*b*). A piece of molybdenum metal 10 initially has an oxide layer 12 thereupon. There may also be a layer 14 of dirt, grease, of other matter on the surface, over the oxide layer 12. The approach of the present invention achieves a progressive removal of the layers 14 and 12, and prevents reformation of the oxide layer 12 long enough so that a nickel or gold strike layer can be deposited.

In the present process, the surface upon which the copper is to be deposited is first cleaned of contaminants such as grease, oil, or dirt. The gross oxide is removed by etching, preferably in two steps of an ammonium bifluoride, nitric acid etch (or sulfuric acid, nitric acid etch) followed by a potassium ferricyanide etch. This procedure removes the greatest portion of the thickness of the molybdenum oxide by chemically attacking the oxide, and may remove all of the oxide. However, even if all of the oxide is etched away, a new, thin base layer of molybdenum oxide immediately forms. The etching treatment by itself does not prevent the reformation of the thin base layer of oxide. A longer time is required to reform the original thick oxide layer.

For the purposes of discussing the effects of the various steps of the present method and in accord with the usual terminology in the industry, the molybdenum oxide layer on the surface may be thought of as having two parts. The "base oxide" is a thin layer of oxide immediately adjacent the molybdenum surface, and can form on a clean molybdenum surface within milliseconds. The "gross oxide" is the remaining thicker portion of the molybdenum oxide, which gradually thickens over a period of time. The base oxide and gross oxide are continuous and of the same composition, and are not physically discernible as different. The terminology is presented only as a way of discussing the formation and removal of oxide on the molybdenum surface. It is useful because some treatments remove the gross oxide or all of the oxide from the surface, but a thin base oxide immediately reforms. However, other treatments may then be used to remove the thin, reformed base oxide, while such treatments do not operate sufficiently rapidly to effectively remove the gross oxide.

After the oxide is removed by etching, the molybdenum piece is made the cathode of an electrolytic cell having a graphite anode. The electrolyte is concentrated hydrochloric acid with a chloride salt added, if necessary, to improve electrical conductivity. Alternatively, other concentrated acids that are not strong oxidizers, such as sulfuric acid, may be used. Before it is placed into the electrolyte, the molybdenum piece is connected to a power supply capable of delivering a sufficient voltage and current, and the power supply is activated. The molybdenum piece is therefore preferably inserted "hot" into the electrolyte, with a potential applied. A treatment in the acid of about 15 seconds to 1 minute has been found sufficient.

Upon completion of the acid treatment, the electrolytic potential is retained, and the molybdenum piece is immediately transferred to a nickel strike electrolyte made up primarily of aqueous nickel chloride solution. Nickel is deposited as a thin layer, in an amount estimated to be about .000010 inch in thickness. Such a thin layer that serves as the underlying layer for a deposited layer, and which improves its adhesion to the metal surface, is termed a "strike layer".

Copper is then deposited over the strike layer. The nickel strike layer prevents the formation of a base oxide on the molybdenum, and the deposition of the copper layer can therefore be deferred until a convenient time. The copper layer is preferably deposited electrolytically from a copper cyanide solution. Finally, a thin gold layer may optionally be deposited overlying the copper layer to protect it from oxidation.

The dirt layer 14 is removed by cleaning of an appropriate type. The cleaning step 16 may include brushing, scrubbing, or similar physical action, if necessary. Ordinarily, however, the molybdenum requires only removal of oils, grease, and the like. This is conveniently performed in a commercial liquid cleaner such as Oakite 90, manufactured by Oakite Corporation. Cleaning is accomplished by immersion of the molybdenum into the cleaning solution. Commercial directions for the cleaning solution are followed. For Oakite, the suggested cleaning step temperature is about 180 F. After the cleaning step 16 is complete, the molybdenum piece 10 has only the oxide layer 12 remaining on its surface 18. Following the cleaning step 16, the molybdenum piece 10 is given a cold water rinse, indicated throughout FIG. 1 by the letters "CWR" on the arrow to the next step.

The oxide layer 12 is removed by etching, in the preferred approach involving two etching steps 20 and 22. In the first etching step 20, the molybdenum piece 10 is immersed in a solution of sulfuric acid and nitric acid, or a solution of ammonium bifluoride and nitric acid at ambient temperature for about 10 seconds. The preferred sulfuric acid and nitric acid etchant has about 65 percent by volume sulfuric acid and 35 percent by volume nitric acid. The preferred ammonium bifluoride and nitric acid etch is a mixture to equal parts by volume of nitric acid and water, to which about 25 grams per liter of ammonium bifluoride is added. Part of the oxide layer 12 is removed. The portion removed is the gross oxide, that is, the major portion of the oxide at the surface 18 of the molybdenum piece 10. After the etching step 20, there remains only a thin base oxide layer 24. The etching step 20 is followed by a cold water rinse.

In the second etching step 22, the molybdenum piece 10 is immersed in an aqueous solution containing about 90 to 120 grams per liter potassium ferricyanide and about 90 to 120 grams per liter potassium hydroxide or sodium hydroxide at ambient temperature for about 30 seconds. This second etching step 22 removes the base oxide 24, leaving a clean molybdenum surface 18. The second etching step 22 is followed by a cold water rinse.

Unfortunately, the clean molybdenum surface 18 is not stable, and a thin reformed oxide layer 26 immediately forms on the surface 18 of the molybdenum 10. This layer 26 is thought to form in milliseconds upon removal of the molybdenum piece 10 from the second etching solution. The layer 26 is believed to be on the order of only a few monolayers thick. With time, the layer 26 grows progressively thicker to form a gross oxide, but at this stage is essentially a base oxide due to its small thickness. It is important that the next step be undertaken before the layer 26 can grow unmanageably thick. That is, the next step is begun within no more than about 5 to 10 seconds after completion of the etch step 22.

Figure 2:
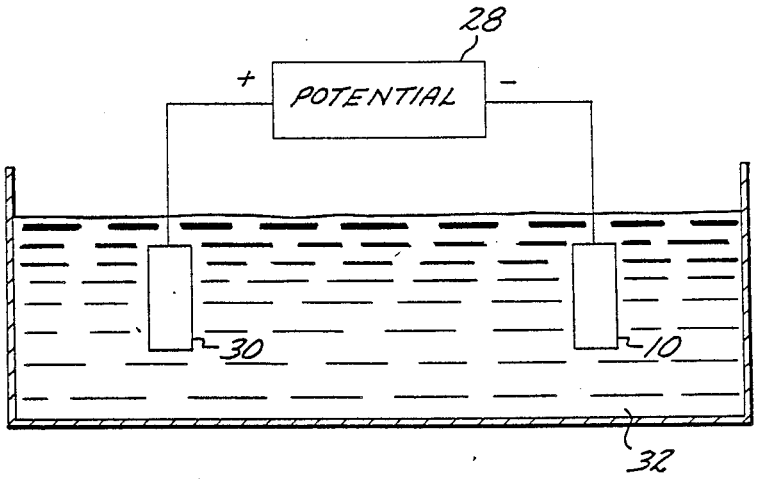
FIG. 2 is an elevational view of the apparatus used in the acid treatment.

As shown in FIG. 2, the molybdenum piece 10 is connected to the negative potential terminal of a power supply 28, and a graphite electrode 30 is connected to the positive potential terminal of the power supply 28. Any other operable material for the anode is acceptable, but the vigorous liberation of gas at the anode readily attacks many other electrode materials. For example, platinized titanium used as the anode was found to be quickly attacked and destroyed.

The electrode 30 and the molybdenum piece 10 are immersed into a concentrated hydrochloric acid solution 32 at ambient temperature, in a hydrochloric acid electrolytic treatment step 34. The power supply 28 is turned on and a potential of about 6 volts established prior to immersion, so that electrode 30 and molybdenum piece 10 are immersed into the solution under an applied potential. The power supply 28 is further controlled to maintain a current density of about 3.5 amps per square inch after immersion. About 10 grams per liter of a monovalent salt is preferably included in the acid solution to increase its electrical conductivity. Nickel chloride is the preferred monovalent salt when a nickel strike layer is being deposited, as it adds no unacceptable impurities to the solution.

The term "concentrated" is used to describe the hydrochloric acid, and further explanation of the meaning as used herein is provided. This term is used commercially to describe hydrochloric acid having about 37% by volume hydrogen chloride in water. It has been found that such concentrated acid is operable in the invention, and that hydrochloric acid of higher concentrations is also operable. It is believed that anhydrous hydrochloric acid would not be operable, since the acid must function as an electrolyte. It has also been found that hydrochloric acid of lesser concentration is also operable, but only to a partial dilution. If the 37% hydrochloric acid is diluted in a ratio of 75% by volume acid to 25% by volume water, the mixture is operable. If, however, the 37% hydrochloric acid is diluted in a ratio of 50% by volume acid and 50% by volume water, the mixture is not operable. Thus, the hydrochloric acid should have a concentration of at least about 25%.

The hydrochloric acid treatment is continued for at least about 15 seconds, and preferably about 1 minute. This treatment removes the reformed oxide layer 26. There is no known limit on the maximum time permitted under this step. A current in the approximate range of 500 to 1000 amps-per-square foot is applied.

At the completion of the hydrochloric acid treatment step 34, the voltage on the molybdenum piece 10 is maintained. The next step of the process varies depending on whether a nickel strike or a gold strike layer is to be applied. If a nickel strike layer is to be applied, the molybdenum piece 10, with voltage applied, is immediately and directly transferred to a nickel strike solution to begin a nickel strike application step 38. The nickel strike solution is preferably one of the Woods nickel strike family of solutions. These solutions are aqueous solutions of nickel chloride in an amount of about 15 to about 75 ounces per gallon and hydrochloric acid in an amount of about 8 to about 32 ounces per gallon. The preferred nickel strike solution 36 has 60 ounces per gallon of nickel chloride and 15 ounces per gallon of hydrochloric acid in water. The solution 36 is at ambient temperature.

The voltage on the cathode, the molybdenum piece 10, is reduced to about 3 volts, after the piece 10 is immersed into the nickel strike solution, and the current is maintained at about 3 amps per square inch. This condition is maintained for a period of time of at least about 30 seconds, to deposit a nickel layer 40 onto the surface 18 of the piece 10. The nickel layer 40 is typically about .000010 inch thick, but the thickness of this layer is not critical. The significance of the layer 40 is that it provides a permanent barrier to the reformation of an oxide layer on the surface of the molybdenum piece 10, and also serves as a strike layer base for depositing copper.

After the layer 40 is deposited, the piece 10 is removed from the nickel strike solution and rinsed with cold water. A copper layer 42 is deposited in a copper deposition step 44. The step 44 need not be initiated in a critically short time after completion of the nickel strike step 38, due to the presence of the nickel layer 40.

If a gold strike layer is to be applied, at the completion of the hydrochloric acid treatment step 34, the molybdenum piece 10, with voltage applied, is immediately and directly transferred to a hydrochloric acid gold strike maintained at an elevated temperature to begin a gold strike application step 38. Any suitable gold strike solution, such as the solution sold under the trade name Aurobond TCL, by Technic Corporation, may be used. the gold strike solution, unlike the nickel strike solution, must be maintained at an elevated temperature which is higher than the ambient temperature. For example, the gold strike solution may be maintained at a temperature in the range of 80° F. to 95° F. It is also important that the strike solution be maintained substantially at the same elevated temperature during the processing step without significant temperature fluctuations. The gold strike bath is generally not as efficient as the nickel chloride strike bath. If more of the energy being applied is used to plate the substrate, this indicates higher efficiency. If more of the applied energy is being used to liberate hydrogen from the cathode, this indicates lower efficiency. Elevating the temperature of the gold strike bath improves the ratio of energy used for plating to energy used for hydrogen release. However, the ratio of plating to hydrogen release should not be increased so much that the processing results in the deposition of a thick "plating" layer instead of a thin "strike" layer. Therefore, the elevated temperature of the gold strike bath should be selected such that, for the current applied, the ratio of plating to hydrogen release has a suitable relationship. If the voltage on the cathode, that is, the molybdenum piece 10, is maintained at about 3 volts, after the piece 10 is immersed in the gold strike solution, the current is maintained at about 10 amps per square foot. This condition is maintained for a period of time, for example 30 seconds plating time to deposit a gold strike layer 40 onto the surface 18 of the piece 10. The gold strike layer 40 is typically about .0000020 inches thick, but the thickness of this layer is not critical. Layer 40 serves as a permanent barrier to the reformation of an oxide layer on the surface of the molybdenum piece 10, and also serves as a strike layer base for subsequent deposition of copper.

After the layer 40 is deposited, the piece 10 is removed from the gold strike solution and is rinsed in cold water. A copper layer 42 is deposited in a copper deposition step 44. As in the case of the nickel strike, the step 44 need not be initiated in a critically short time after completion of the gold strike step 38, due to the protective presence of the gold layer 40.

In the preferred approach to the copper deposition step 44, the molybdenum piece 10 is made the cathode in an electrodeposition cell. A copper containing solution preferably contains copper cyanide as a source of copper. The preferred copper cyanide solution contains 4 ounces per gallon of copper cyanide, about 1 to 2.0 ounces per gallon of free sodium cyanide, and 0.5 to 1.5 ounces per gallon of sodium hydroxide to render the solution alkaline. The solution is heated to a temperature of about 75° F. to 140° F. and strongly agitated. The voltage between the anode and the molybdenum piece 10 cathode is about 2 volts, and the current density at the cathode is about 2.5 amperes per square inch. Plating is continued for as long as necessary to build up the desired thickness of copper. Under the plating conditions described above, a thickness of copper of about .0005 inches is deposited in 15 minutes. (Alternatively, the piece 10 could be transferred to a conventional copper cyanide bath for plating the remainder of the copper layer, rather than completing the plating in the described solution.) At the completion of the copper depostion step 44, the plated piece 10 is rinsed in cold water.

In some applications, the plated molybdenum piece 10 is not used for weeks or months after completion of the copper deposition step 44. If such a delay is expected, the copper layer 42 is protected against oxidation by depositing a thin layer of gold 48 thereupon, in a gold deposition step 50. The gold layer 48 is deposited to be about 50–80 millionths of an inch in thickness. To deposit the layer 48, the copper-plated molybdenum piece 10 is made the cathode in a gold deposition cell. The anode is platinized titanium. The gold is deposited from a gold containing solution having about 1 ounce per gallon of potassium gold cyanide. The deposition is accomplished at a temperature of 100 F., and with an applied voltage of 1 volt for 10 minutes.

Samples of molybdenum were plated with copper using the preferred process just described. The copper coating adhered well to the surface.

If this preferred approach is followed, the yield of acceptable product is virtually 100%. The plated molybdenum pieces are uniform and of good appearance. Large numbers of pieces can be processed simultaneously in commercial production, and the results within each batch and between batches are highly reproducible. The process is not sensitive to differences between operators, as long as the specified processing is followed. It is inexpensive in practice, as conventional electroplating equipment and inexpensive chemicals may be used.

Although a particular embodiment of the invention has been described in detail for purposes of illustration, various modifications may be made without departing from the spirit and scope of the invention. Accordingly, the invention is not to be limited except as by the appended claims.

What is claimed is:

1. A process for depositing copper onto the surface of a molybdenum substrate, comprising the steps of:

furnishing a piece of molybdenum to serve as a substrate;

cleaning the surface of the substrate;

etching the surface of the substrate to remove gross oxide from the surface;

placing the surface of the substrate into concentrated hydrochloric acid with the substrate made cathodic;

transferring the substrate from the hydrochloric acid into a nickel-containing strike solution, while maintaining the cathodic potential on the substrate;

depositing a nickel strike layer onto the substrate from the strike solution with the substrate cathodic; and depositing copper onto the substrate overlying the nickel strike layer.

2. The process of claim 1, wherein the strike solution contains nickel chloride in an amount of from about 15 to about 75 ounces per gallon and hydrochloric acid in an amount of from about 8 to about 32 ounces per gallon.

3. The process of claim 1, wherein the cathodic voltage is applied to the substrate when it is placed into the concentrated hydrochloric acid.

4. The process of claim 1, wherein said step of depositing copper includes the substep of:

placing the substrate into a solution of copper cyanide and applying a cathodic potential to the substrate.

5. The process of claim 1, wherein the anode in said step of placing is graphite.

6. A process for depositing copper onto the surface of a molybdenum substrate, comprising the steps of:

furnishing a piece of molybdenum to serve as a substrate;

cleaning the surface of the substrate;

rinsing the surface of the substrate in cold water;

etching the surface of the substrate in a mixture of nitric acid and a second component selected from the group consisting of sulfuric acid and ammonium bifluoride to remove gross oxide from the surface;

rinsing the surface of the substrate in cold water;

etching the surface of the substrate in aqueous potassium ferricyanide to remove gross oxide from the surface;

rinsing the surface of the substrate in cold water;

placing the surface of the substrate into a concentrated aqueous hydrochloric acid solution having a concentration of at least about 25 percent acid, with the substrate made cathodic at about 6 volts;

transferring the substrate from the hydrochloric acid into an acidic aqueous strike solution of nickel chloride, while maintaining the cathodic potential on the substrate;

depositing a nickel strike layer onto the substrate from the strike solution at a cathodic voltage of about 3 volts;

rinsing the surface of the substrate in cold water: and depositing copper onto the substrate overlying the nickel strike layer from a copper cyanide solution.

7. The process of claim 6, wherein the strike solution contains nickel chloride in an amount of from about 15 to about 75 ounces per gallon and hydrochloric acid in an amount of from about 8 to about 32 ounces per gallon.

8. The process of claim 6, wherein the cathodic voltage is applied to the substrate when it is placed into the concentrated hydrochloric acid.

9. The process of claim 6, wherein the anode in said step of placing is graphite.

10. The process of claim 6, including the further step of depositing a gold layer over the copper layer.

11. A process for depositing copper onto the surface of a molybdenum substrate, comprising the steps of:

providing a molybdenum substrate;

cleaning the surface of the substrate;

etching the surface of the substrate to remove gross oxide from the surface;

placing the surface of the substrate into concentrated hydrochloric acid with the substrate made cathodic;

transferring the substrate from the hydrochloric acid into a gold-containing strike solution while maintaining the cathodic potential on the substrate and maintaining the gold-containing strike solution at an elevated temperature above ambient;

depositing a gold strike layer onto the substrate from the strike solution with the substrate cathodic; and depositing copper onto the substrate overlying the gold strike layer.

12. The process of claim 11, wherein the strike solution comprises a hydrochloric acid gold strike solution.

13. The process of claim 11, wherein said elevated temperature is between about 75° F. to 95° F.

14. The process of claim 11, further including the step of depositing a gold layer on top of said copper layer.

15. A process for depositing copper onto the surface of a molybdenum substrate, comprising the steps of:

furnishing a piece of molybdenum to serve as a substrate;

cleaning the surface of the substrate;

rinsing the surface of the substrate in cold water;

etching the surface of the substrate in a mixture of nitric acid and a second component selected from the group consisting of sulfuric acid and ammonium bifluoride to remove gross oxide from the surface;

rinsing the surface of the substrate in cold water;

etching the surface of the substrate in aqueous potassium ferricyanide to remove gross oxide from the surface;

rinsing the surface of the substrate in cold water;

placing the surface of the substrate into aqueous hydrochloric acid solution having a concentration of at least about 25% acid, with the substrate made cathodic and applying a current of about 500 to 1000 amps per square foot;

transferring the substrate from the hydrochloric acid into a hydrochloric acid gold strike solution maintained at an elevated temperature above ambient, while maintaining the cathodic potential on said substrate;

depositing a gold strike layer onto the substrate from the strike solution at a cathodic voltage of about 3 volts and a current of about 10 amps per square foot;

rinsing the surface of the substrate in cold water; and depositing copper onto the gold strike layer from a copper cyanide solution.

16. The process of claim 15, further including the step of depositing a gold layer over the copper layer.

* * * * *